US005197529A

United States Patent [19]

Caugherty

[11] Patent Number: 5,197,529

[45] Date of Patent: Mar. 30, 1993

[54] METHOD AND APPARATUS FOR DIE CASTING METAL

[76] Inventor: Bill Caugherty, 10605 Oak Valley Rd., Fort Wayne, Ind. 46845

[21] Appl. No.: 415,572

[22] Filed: Oct. 2, 1989

[51] Int. Cl.[5] ..... B22D 17/02; B22D 17/12

[52] U.S. Cl. ..... 164/113; 164/312; 164/316

[58] Field of Search ..... 164/312, 316, 113, 335, 164/150, 4.1

[56] References Cited

U.S. PATENT DOCUMENTS

| | | | |
|---|---|---|---|
| 2,393,588 | 1/1946 | Cherry | 164/316 |
| 3,196,502 | 11/1962 | Wagner | 164/4.1 |
| 4,747,444 | 5/1988 | Wasem | 164/150 |

FOREIGN PATENT DOCUMENTS

| | | | |
|---|---|---|---|
| 555139 | 1/1980 | Japan | 164/316 |
| 60-148654 | 8/1985 | Japan | 164/316 |
| 574213 | 12/1945 | United Kingdom | 164/316 |
| 9002017 | 3/1990 | World Int. Prop. O. | 164/316 |

*Primary Examiner*—Richard K. Seidel
*Assistant Examiner*—Rex E. Pelto
*Attorney, Agent, or Firm*—Weintraub, DuRoss & Brady

[57] ABSTRACT

An apparatus for casting metal includes an outer housing, a liner disposed within the housing and defining a melt tank therewithin, at least one layer of insulation between the housing and the liner, a heating element, a shot tube in the housing external of the melt tank, and a piston disposed within the shot tube for ejecting molten metal from an outlet thereof. A method of die casting a metal is also disclosed, as well as a die casting system including the described apparatus.

3 Claims, 2 Drawing Sheets

10
12
14
16
18
20
22
24
26
28
30
32
34
36
38
40
42
44
46
48
50
52
54
56
58
60
62
80
2
3

METHOD AND APPARATUS FOR DIE CASTING METAL

BACKGROUND OF THE INVENTION

1. Field of the Invention

The present invention relates to a method of and an apparatus for melting a metal and injecting the melted metal into a mold or die in a die casting operation.

2. Prior Art

Die casting, per se, has been known since the mid-1800's. However, some aspects of the industry rely on tradition without considering new materials and knowledge.

In pressure die casting, two processes are generally used, namely, the hot chamber process and the cold chamber process.

In the hot chamber process, it has been traditional in the art to use a gooseneck type of apparatus, with a plunger arrangement suspended within a crucible, the plunger moving downward vertically to push molten metal through a passageway and out into a die.

In the cold chamber process, a piston is disposed horizontally in a bore having a hole in the top of the bore, forward of the piston. Molten metal is poured into the hole in the bore and the piston is, then, moved horizontally to force the molten metal into a die.

One drawback of the prior art is that no provision has been made for the casting of aluminum using the hot chamber process, which is generally more adaptable to high volume production, since it keeps a reservoir of molten metal within the apparatus at all times. Another disadvantage of the prior art equipment for the hot chamber process is that the gooseneck apparatus used is basically derived from Dusenbery's die casting machine which was invented in 1877, and no major re-thinking of the optimal type of machine has been done.

An overview of the history of pressure die casting and the two processes is given in *Pressure Die Casting-Part* 1 by B. Upton, published in 1982 by Pergamon press.

An example of prior art relating to a die casting machine is U.S. Pat. No. 4,356,858 issued to Perrella et al. In Perrella, a die casting system is disclosed in which a part is cast and trimmed without any lateral movement of the part. The apparatus as shown in FIG. 8A of Perrella is a variation on the traditional goose neck hot chamber design. A need exists, in the die casting art, for a method and apparatus which will enable aluminum parts to be die cast using a hot chamber process.

SUMMARY OF THE INVENTION

The present invention provides an improved die casting apparatus particularly suitable for die casting aluminum and aluminum alloys in a hot chamber process, and a novel process of die casting a metal workpiece. The present invention also provides a complete automated die casting system.

An apparatus for injecting metal into a die in accordance with the present invention comprises:

(a) an outer housing;

(b) a liner disposed within the housing and defining a melt tank therewithin, the liner being formed from a refractory material;

(c) at least one layer of insulating material interposed the housing and the liner for substantially retaining heat within the housing;

(d) means for allowing addition of a metal to the melt tank;

(e) means in the housing for heating the melt tank to melt the metal;

(f) a shot tube disposed within the housing external of the melt tank for accumulating molten metal therein, the shot tube being formed from a refractory material and having a passageway formed therein for flow therethrough of the metal, the shot tube terminating at an outlet;

(g) means for transferring molten metal from the melt tank to the shot tube;

(h) a piston disposed within the passageway of the shot tube; and (i) means for moving the piston in the passageway to eject metal from the outlet.

In one embodiment, the liner is formed from a refractory plastic material and the shot tube is formed from fused silica.

For a more complete understanding of the present invention, reference is made to the detailed description section. Throughout the following description and in the claims, like reference numbers are used to refer to the same or analogous parts shown in multiple views in the drawings, in which:

DETAILED DESCRIPTION OF THE PREFERRED EMBODIMENT

Figures 1, 2, 3:
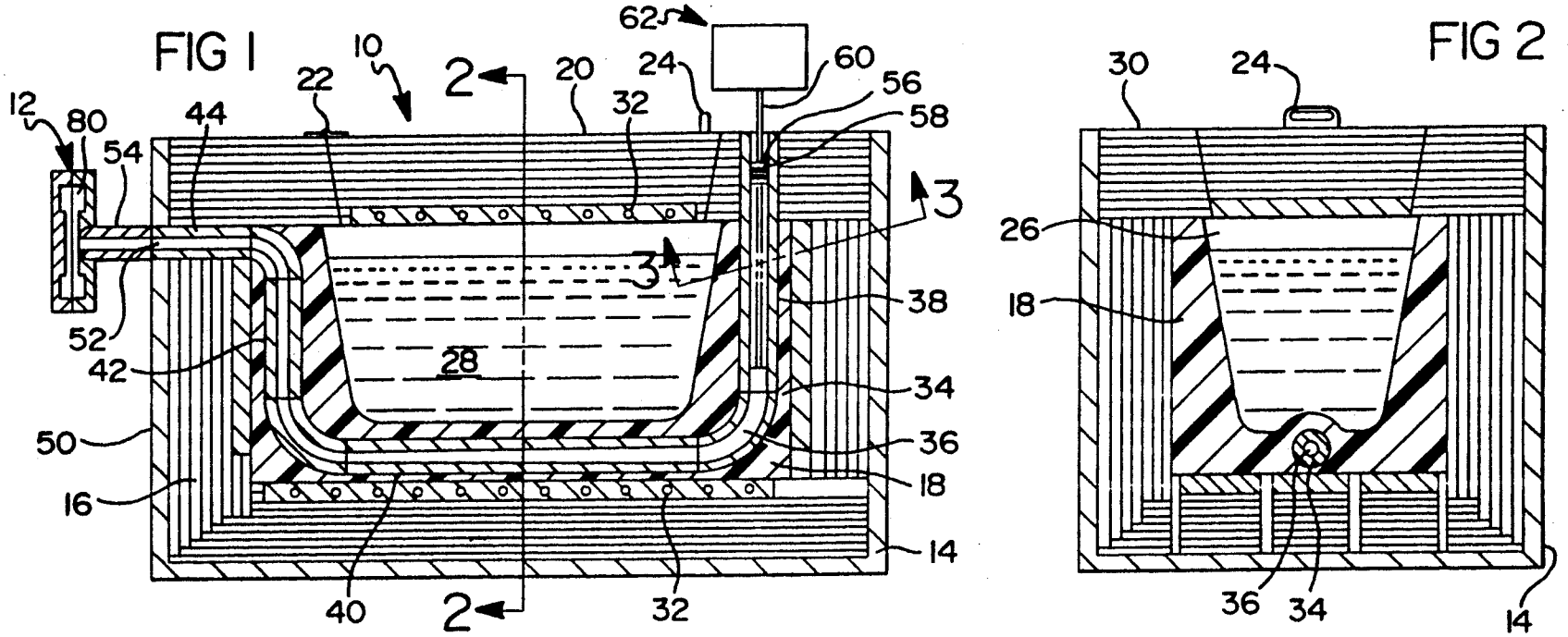
FIG. 1 is a cross-sectional view of a furnace and injecting machine in accordance with of the present invention, showing the apparatus connected to a die by the use of a nozzle.
FIG. 2 is a second cross-sectional view of the embodiment of FIG. 1, taken along the line 2—2 of FIG. 1.
FIG. 3 is a cross-sectional view of the wall of the liner of FIG. 1, taken along the line 3—3 of FIG. 1.

Referring to FIG. 1, an apparatus for injecting metal into a die 12 is shown generally at 10. The injection apparatus of the present invention has an outer support housing 14 surrounding a plurality of layers 16 of insulating material, such as, e.g., fiberglass or the like. Disposed within the insulating layers 16 in the housing 14 is a liner 18 which is formed from a refractory material. In a preferred embodiment, the liner 18 is formed from a refractory plastic such as, e.g., that sold by A. P. Green under the name "Green Pack 85 Plus".

A door 20 is provided in the top of the apparatus 10 and the door 20 includes a hinge 22 attaching it to the main body 30 of the apparatus 10. The door 20 also is provided with a handle 24 for opening the door 20, thus providing a means for allowing addition of a metal, such as aluminum, to the interior of the apparatus 10 in which the hollow liner 18 defines a melt tank 26. In FIGS. 1 and 2, the melt tank 26 is shown substantially filled with a molten metal 28.

The apparatus 10 of the present invention is provided with a means for heating the melt tank 26 to melt the metal 28 therein. In the embodiment of FIGS. 1-2, the means for heating the melt tank is electrical resistance heater wire 32 which is provided both immediately below the liner 18 and in the door 20 above the melt tank 26. This is powered by standard 220 volt or other industrial electrical power as is known in the industry.

A shot tube 34 for accumulating molten metal therein is disposed within the housing 14 and in the pictured embodiment is disposed internally within the liner 18 and external of the melt tank 26. The shot tube 34 is formed from a refractory material, one suitable material being fused silica or silicon dioxide. The shot tube 34 has a passageway or bore 36 formed therein, for flow therethrough of the metal 28. The shot tube is formed in three major sections. The first section 38 of the shot tube extends downwardly adjacent the melt tank 26 as shown in FIG. 1.

Referring to FIG. 3, it is seen that a pair of transport tubes 46, 48 are formed in the liner connecting the shot tube 34 to the melt tank 26. The transport tubes 46, 48 may be formed of fused silica or a material different from that of the liner 18, or may simply be hollow passages formed within the liner 18. In the embodiment of FIGS. 1-3, the transport tubes 46, 48 are formed in an upward angle from the melt tank to the first section 38 of the shot tube 34, as shown by the line 3—3 in FIG. 1. These transport tubes 46, 48 provide a means for transferring molten metal from the melt tank 26 to the shot tube 34, and the shot tube 34 fills with molten metal until the height of metal in the shot tube 34 is equal to the height of metal in the melt tank 26 as shown in FIG. 1, since a fluid seeks its own level. The shot tube 34 also includes a second section 40, the second section extending from the first section below the melt tank. The second section 40 is in fluid communication with the first section 38. The shot tube 34 also includes a third section 42 in fluid communication with the second section, the third section 42 extending upwardly therefrom and bending into a terminal portion 44, extending to an outer surface 50 of the housing 14. The passageway 36 in the shot tube terminates at an outlet 52 which is adjacent the outer surface 50 of the housing. As shown in FIG. 1, the outlet 52 is connectable to a die 12 by means of a nozzle 54. As will be subsequently detailed herein, metal is injected into the die 12 after passing through the nozzle 54 into which the metal moves from the outlet 52 of the shot tube 34.

Disposed within the shot tube 34 in the first section 38 thereof, is a piston 56 which may have one or more piston rings 58 disposed in circumferential grooves thereon for forming a seal between the piston 56 and the passageway 36 of the shot tube 34. A piston rod 60 connects the piston 56 to a piston driving or actuating mechanism 62. The piston driving mechanism 62 provides a means for moving the piston 56 downwardly in the shot tube 34 to eject metal 28 from the outlet 52 which is subsequently injected into the die 12. The piston driving mechanism 62 may be pneumatic or hydraulic and such mechanisms are well known to those skilled in the die casting art.

The shot tube 34 preferably tapers as it moves progressively from the first section 38 through the second section 40 and toward the outlet 52. This tapering effect increases the pressure built up within the shot tube when the piston 56 moves downwardly therein. The first section 38, however, is not substantially tapered in the portion in which the piston travels.

Once the molten metal 28 fills the shot tube 34 to the same level as the level in the melt tank 26, the piston actuating mechanism 62 moves the piston downwardly in the first section of the shot tube 34. As soon as the piston 56 moves past the transfer tubes 46, 48 pressure begins to develop in the shot tube 34 below the piston 56 until the fluid begins to move in the passageway 36 and then begins to flow out from the outlet 52 into and through the nozzle 54 and into the die 12. The piston travels a predetermined distance sufficient to fill the die 12, and is subsequently returned to its initial position, whereupon the shot tube 34 once again begins refilling through the transport tubes 46, 48.

Figure 4:
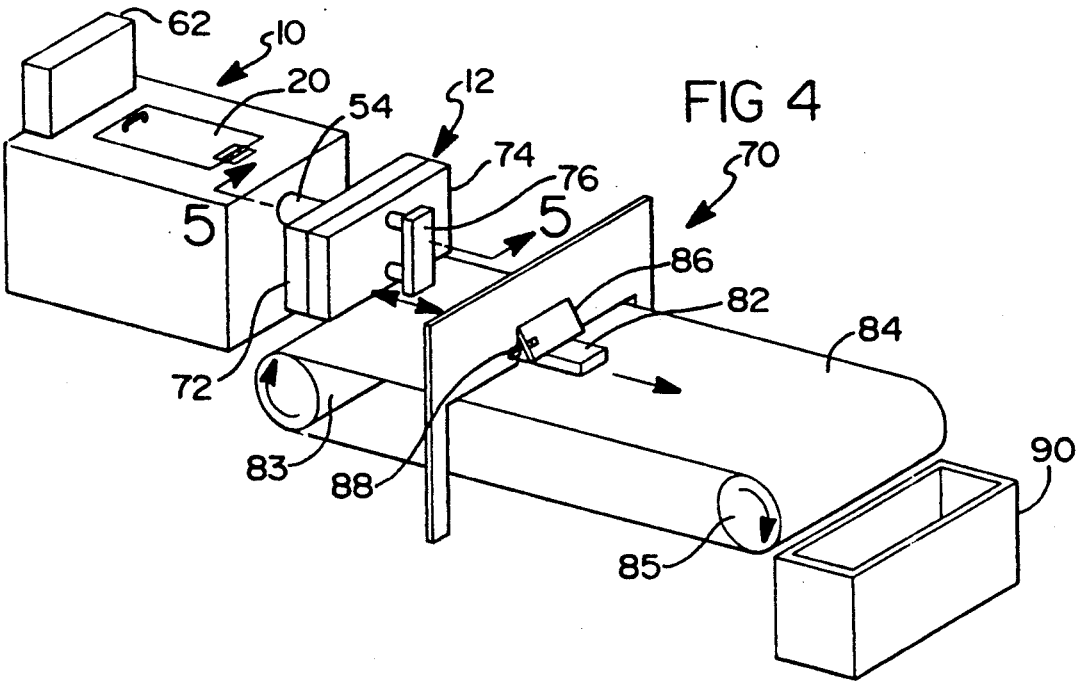
FIG. 4 is a perspective view of an automated die casting system in accordance with the present invention.
Figure 5A:
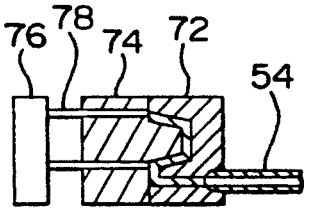
FIGS. 5A, 5B, and 5C are sequential cross-sectional views of the die and nozzle of FIG. 4, taken along the line 5—5 of FIG. 4.
Figure 5B:
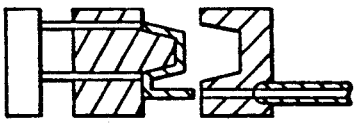
Figure 5C:
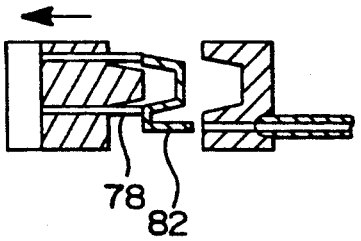

Referring now to FIGS. 4 and 5, a production system is shown generally at 70. The apparatus 10 of FIGS. 1-3 is a portion of the system 70. This system 70 is able to be automatically configured so that once it is activated, when the metal 28 in the melt tank 26 is of a sufficient temperature, the entire process can be made automatic. Such an automatic process begins with a closing of the die 12 which is made up of a fixed block 72 and a first moving block 74. A second moving block 76 has a pair of ejector pins 78 extending therefrom and through the first moving block 74. In FIGS. 4 and 5, in order to simplify the drawings, the support structure for the first and second moving blocks 74, 76 is omitted, and only the essential parts are shown. One skilled in the art of die casting metals will recognize that support for these moving blocks 74, 76, is necessary, and may be, e.g., hydraulically or mechanically actuated. Similarly, structural support must be provided for the fixed block 72 and the nozzle 54. Once the die 12 is closed as shown in FIG. 5A, the piston actuating mechanism 62 moves the piston downwardly in the first section 38 of the shot tube 34 as hereinabove described, thus, filling the space 80 within the die to form a part or workpiece 82. After a predetermined period of time sufficient to allow the workpiece 82 to solidify, the first and second moving blocks 74, 76 are moved as a unit away from the fixed block 72 taking the cast part 82 which was formed in the space 80 within the die 12 away from the fixed block 72 as shown in FIG. 5B. After the first and second moving blocks 74, 76 have moved away from the fixed block 72, the second moving block 76 stops, and the first moving block 74 continues to move on the pins 78 back in the direction shown in FIG. 5C. This moves the ejector pins 78 through the first moving block 74 and pushes the formed part 82 off of the first moving block 74, and the part 82 then falls onto a conveyor belt 84. Conventional hydraulics may be used to move the blocks 74, 76.

The belt 84 is moved by rollers 83, 85 in the direction of the arrows shown in FIG. 4 and the part 82 then moves on the belt 84 and passes through a signal door 86 having a sensor switch 88 incorporated therein. The signal door 86 moves easily and is pushed open by the action of the conveyor belt pressing the part 82 against the door 86. When the door 86 opens to let the part 82 pass, the sensor switch 88 sends a signal to the piston actuating mechanism 62 which then begins the cycle again after the die 12 is once again closed. This automated process is preferable to the prior art in that required functions of an operator of the machine are greatly minimized. After moving down the conveyor belt 84, the parts collect in a bin 90.

The method and apparatus of the present invention is particularly suitable for die casting aluminum or aluminum alloys, which has not been feasable with the prior art systems. This is due both to the physical structure of the apparatus and the materials disclosed herein.

Although the present invention has been described herein with respect to a specific embodiment thereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

Having, thus, described the invention, what is claimed is:

1. A die casting system, comprising:
(a) means for injecting molten metal into a die;
(b) means for ejecting the metal from the die in the form of a workpiece after the metal has substantially solidified;
(c) means for conveying the workpiece to a collection container;
(d) a signalling door interposed the ejecting means and the collection container, the signalling door operable by movement therepast of a workpiece on the conveyor means;
(e) a switch on the signalling door to signal the passage therethrough of a workpiece.

2. The system of claim 1, wherein the means for injecting molten metal comprises:
(a) an outer housing;
(b) a liner disposed within the housing and defining a melt tank therewithin; the liner being formed from a refractory material;
(c) at least one layer of insulating material interposed the housing and the liner for substantially retaining heat within the housing;
(d) means for allowing addition of a metal to the melt tank;
(e) means for heating the melt tank to melt the metal;
(f) a shot tube disposed within the housing external of the melt tank for accumulating molten metal therein, the shot tube being formed of a refractory material and having a passageway formed therein to flow therethrough of the metal, the shot tube terminating at an outlet;
(g) means for transferring molten metal from the melt tank to the shot tube;
(h) a piston disposed within the passageway of the shot tube; and
(i) means for moving the piston in the passageway to eject metal from the outlet.

3. An apparatus for casting metal, comprising:
(a) an outer housing;
(b) a liner disposed within the housing and defining a melt tank therewithin; the liner being formed form a refractory material;
(c) at least one layer of insulating material interposed the housing and the liner for substantially retaining heat within the housing;
(d) means for allowing addition of a metal to the melt tank;
(e) means for heating the melt tank to melt the metal;
(f) a shot tube disposed within the housing external of the melt tank for accumulating molten metal therein, the shot tube being formed of a fused silica and having a passageway formed therein for flow therethrough of the metal, the shot tube terminating at an outlet;
(g) means for transferring molten metal from the melt tank to the shot tube;
(h) a piston disposed within the passageway of the shot tube; and
(i) means for moving the piston in the passageway to eject metal from the outlet.

* * * * *